US007497166B2

(12) United States Patent
Fuerst et al.

(10) Patent No.: US 7,497,166 B2
(45) Date of Patent: Mar. 3, 2009

(54) RAILWAY PLATE INSERTER

(75) Inventors: James W. Fuerst, Wauwatosa, WI (US); Bruce Blazek, Pewaukee, WI (US); Donald M. Treziak, Jr., Sturtevant, WI (US); Robert M. Weber, Wadsworth, IL (US)

(73) Assignee: Nordco Inc., Oak Creek, WI (US)

( * ) Notice: Subject to any disclaimer, the term of this patent is extended or adjusted under 35 U.S.C. 154(b) by 298 days.

(21) Appl. No.: 11/363,381

(22) Filed: Feb. 27, 2006

(65) Prior Publication Data

US 2007/0199473 A1 Aug. 30, 2007

(51) Int. Cl.
*E01B 3/00* (2006.01)
*E01B 29/26* (2006.01)
*E01B 29/24* (2006.01)

(52) U.S. Cl. ..... 104/16; 104/17.1; 104/17.2

(58) Field of Classification Search ..... 104/16, 104/17.1, 17.2
See application file for complete search history.

(56) References Cited

U.S. PATENT DOCUMENTS 3,762,333 A * 10/1973 Theurer et al. ..... 104/12
3,943,858 A * 3/1976 Dieringer et al. ..... 104/16
4,241,663 A * 12/1980 Lund et al. ..... 104/16
4,554,624 A * 11/1985 Wickham et al. ..... 702/33
4,691,639 A * 9/1987 Holley ..... 104/16
5,067,412 A * 11/1991 Theurer et al. ..... 104/16
5,331,899 A * 7/1994 Holley ..... 104/16
5,615,616 A * 4/1997 Scheuchzer et al. ..... 104/2
5,655,455 A * 8/1997 Smith ..... 104/16
5,671,679 A * 9/1997 Straub et al. ..... 104/2
5,730,060 A * 3/1998 Straub et al. ..... 104/17.2
6,595,140 B1 * 7/2003 Madison et al. ..... 104/16
6,863,717 B2 * 3/2005 Johnsen et al. ..... 106/6
2007/0199473 A1 * 8/2007 Fuerst et al. ..... 104/16

* cited by examiner

*Primary Examiner*—S. Joseph Morano
*Assistant Examiner*—Jason C Smith
(74) *Attorney, Agent, or Firm*—Greer, Burns & Crain, Ltd.

(57) ABSTRACT

A railway vehicle for inserting plates on rail ties that engage with rails includes a frame configured for movement relative to the track and a plate inserter workhead mounted to the frame. The plate inserter workhead is configured for pivoting the tie plate about a leading edge of the plate so that the trailing edge of the tie plate is lifted off the tie. The plate inserter workhead is configured to subsequently release the plate.

8 Claims, 11 Drawing Sheets

RAILWAY PLATE INSERTER

BACKGROUND OF THE INVENTION

The present invention relates generally to railroad right-of-way installation or maintenance machines, and specifically to a railway plate inserter for applying rail plates to rail ties, and a method of inserting the plates.

Conventional railroad track consists of a plurality of spaced parallel wooden ties to which are attached a pair of spaced rail tie plates. Each tie plate is configured to rest on the upper surface of the tie and includes holes for receiving spikes or screws, as well as a canted seat or a cradle formation for receiving the bottom or base of the steel rail. Since two rails make up a railroad track, there are a pair of spaced tie plates on each tie. Some of the spikes are used to secure the tie plate on the tie and others are used to secure the base of the rail to the tie plate cradle.

When laying a new railroad track, replacing worn ties, or when laying new rails on a pre-existing railroad track, it is necessary to provide and position tie plates on the railroad ties. One plate is required for each side of each tie. The plates are initially placed adjacent the track, either by a crane or by a work gang. Then, the plates are placed onto the top surface of the tie. Subsequently, the plate must be positioned to the proper location on the tie to receive the rail.

Proper positioning of the plate on the tie requires the work gang to center the plate on the width direction of the tie, and position the plate under the rail to receive the bottom portion of the rail in the recess of the plate. In the past, the work gang has had to lift the rail or the tie in order to properly position the plate. It will be appreciated that the manual placement involves high labor costs, inconsistent accuracy of placement, and a time consuming process.

To avoid on the job injuries, especially those involved with handling tie plates, which typically weigh approximately 18-40 pounds and are awkward to manipulate, railways have attempted to mechanize the plate insertion process as much as possible. Such systems have not been widely accepted by the railroads because of the relatively complicated mechanisms involved in performing the insertion.

Additionally, there is inaccuracy in some of the insertion machines, particularly when there are irregularities in plate sizes and shapes. For example, the plates used on a curve in the track are larger than the plates used on a straight stretch of track. Deviations of as little as ⅜ of an inch in the plate is significant in terms of an insertion machine being able to properly place the plate. Due to these variations, frequent readjustment of settings is required to accommodate different sizes and shapes of plates.

Further, in many instances the insertion of the new plate is impeded by railway ballast. Conventional mechanisms have no way to remove unwanted ballast particles from the top surface of the tie.

Railroad installation and maintenance machines typically include a frame which is either self-propelled or towable along the track, and a plate inserter configured to perform the maintenance task. Such devices typically have a travel position, where the portion of the plate inserter is held sufficiently above the track to avoid damage by obstacles including the track itself, and a work position. During operation in the work position, the units typically move between a loading position for loading the part, and a track engaging position for applying the repair part. To avoid damage to the mechanisms, such units are designed for operation so that either travel is prohibited when these mechanisms are in the latter two positions, or the mechanisms automatically rise to the travel position when the unit begins to move to the next location.

While protecting the plate insertion mechanisms, these conventional operational precautions tend to take time and limit productivity of the plate insertion process. Further, in cases where the plate inserter is one of a chain of maintenance machines, the productivity of the overall maintenance of the railroad is limited as measured by the rate of the slowest unit.

Accordingly, there is a need for an improved plate inserter which reduces the manual handling of plates during the plate insertion process.

There is also a need for an improved plate inserter which enables a high frequency of plate insertions while protecting the plate inserting mechanisms.

Further, there is a need for an improved plate inserter which is accurate despite variations in the track, and which does not require readjustment to accommodate the variations in the track.

SUMMARY OF THE INVENTION

The above-identified objects are met or exceeded by the present railway vehicle for inserting plates on rail ties that engage with rails. The railway vehicle includes a frame configured for movement relative to the track. Mounted on the frame is a plate inserter workhead configured for pivoting the tie plate about a leading edge so that a trailing edge of the tie plate is lifted off the tie. The plate inserter workhead is also configured for subsequently releasing the plate.

More specifically, the present invention provides a railway vehicle for inserting tie plates located on rail ties that engage with rails, each tie plate having a field side shoulder. The railway vehicle includes a frame configured for movement relative to the track. Mounted on the frame is a plate inserter workhead configured for engaging the field side shoulder and pushing the plate along the rail tie. The plate inserter workhead is also configured for subsequently releasing the plate.

In a preferred embodiment, a railway vehicle for inserting plates located on rail ties that engage with rails includes a frame configured for movement relative to the track. The plate inserter workhead is mounted on the frame and is configured for engaging a field side shoulder of the plate with a base of the rail. The plate inserter workhead is also configured for subsequently releasing the plate.

A preferred method for inserting tie plates on railroad ties on a railroad track having a pair of rails includes pivoting the tie plate in a direction towards the rail and about a leading edge of the tie plate. The method also includes engaging the tie plate with the base of the rail and releasing the tie plate to allow it to fall upon the track with the rail engaged on the tie plate.

A plate pusher in a plate pusher assembly having a pushing arm is provided. The plate pusher includes a first portion having an attachment formation for linking the plate pusher to the plate pusher arm, and at least one contact body attached to or integral with the first portion. The contact body extends generally transverse to the first portion in the vertical direction. Also included is a distal end on the contact body which is offset in the vertical direction from the attachment formation. The distal end has an engaging formation configured to engage the plate.

A stop pin assembly for opposing the motion of a plate on a tie in a plate inserter is provided. The stop pin assembly includes an elongate member having a first end operatively attached to the plate inserter workhead, and a distal end opposite of the first end. The distal end has a tip attached to and extending therefrom, the tip being configured to engage the tie. At least one attachment structure is disposed on the elongate member and is configured for receiving a corresponding attachment structure of a locator tool to attach the locator tool to the stop pin.

A preferred locator tool for attachment to stop pins in a plate inserter workhead is provided. The locator tool includes an extension portion extending between at least two stop pins. The extension portion includes at least one attachment structure configured to engage a corresponding attachment structure on the stop pins. Also included is a receiving portion, which is attached to or integral with the extension portion. The receiving portion includes a receiving formation configured to receive a leading edge of a plate and to permit the leading edge to pivot within the receiving formation.

The present centering finger assembly on a plate centering workhead for centering a tie plate on a tie in a plate inserter includes a plate centering housing. The housing has two opposing sides generally corresponding to the width of the tie plate. There is at least one centering finger on each of the two opposing sides of the plate centering housing. The centering finger has a first end disposed on the plate centering housing, a distal end disposed opposite of the first end, and a body located between the first and second ends. The body has a spring bias toward the opposite centering finger. The spring bias is configured to maintain the plate centered on the tie as the plate is moved along a top surface of the tie and between the opposing centering fingers.

A preferred workhead-centering mechanism on a plate inserter workhead for centering the workhead above a tie is provided. The workhead-centering mechanism includes at least two tie gripper arms configured for controlled reciprocation in a direction parallel to a rail and towards the tie. A first tie gripper arm is disposed adjacent a first side surface of the tie, and a second tie gripper arm is disposed adjacent a second side surface of the tie. At least one rod is disposed between the tie gripper arms and located above the tie. Also included is at least one cylinder for converging the tie gripper arms along the rod and engaging on the first and second side surfaces of the tie to center the plate inserter workhead between the tie gripper arms.

A rail locator on a plate-stopping mechanism of a plate inserter workhead is provided. The rail locator includes a first portion having an attachment formation for linking the rail locator to the plate-stopping mechanism. At least one contact body is attached to or integral with the first portion. The contact body extends generally perpendicular to the first portion in the horizontal direction. A recess is located in the contact body at a lower surface. The lower surface is configured to engage a side surface of a rail, and the recess is configured to accommodate a plurality of rail ball shapes.

A preferred tie gripper arm assembly on a workhead-centering mechanism of a plate inserter workhead is provided. The workhead-centering mechanism is configured to reciprocate the tie gripper arm assembly in a direction parallel to the rail. The tie gripper arm assembly includes at least one tie gripper arm extending in a first direction, and a second portion attached to the tie gripper arm and generally perpendicular to the tie gripper arm. Also included is a bolt mount portion attached to at least one of the second portion and the tie gripper arm. The bolt mount portion has at least one attachment formation configured to be attached to the workhead-centering mechanism for reciprocating the tie gripper arm assembly parallel to the rail.

DETAILED DESCRIPTION OF THE INVENTION

Figure 1:
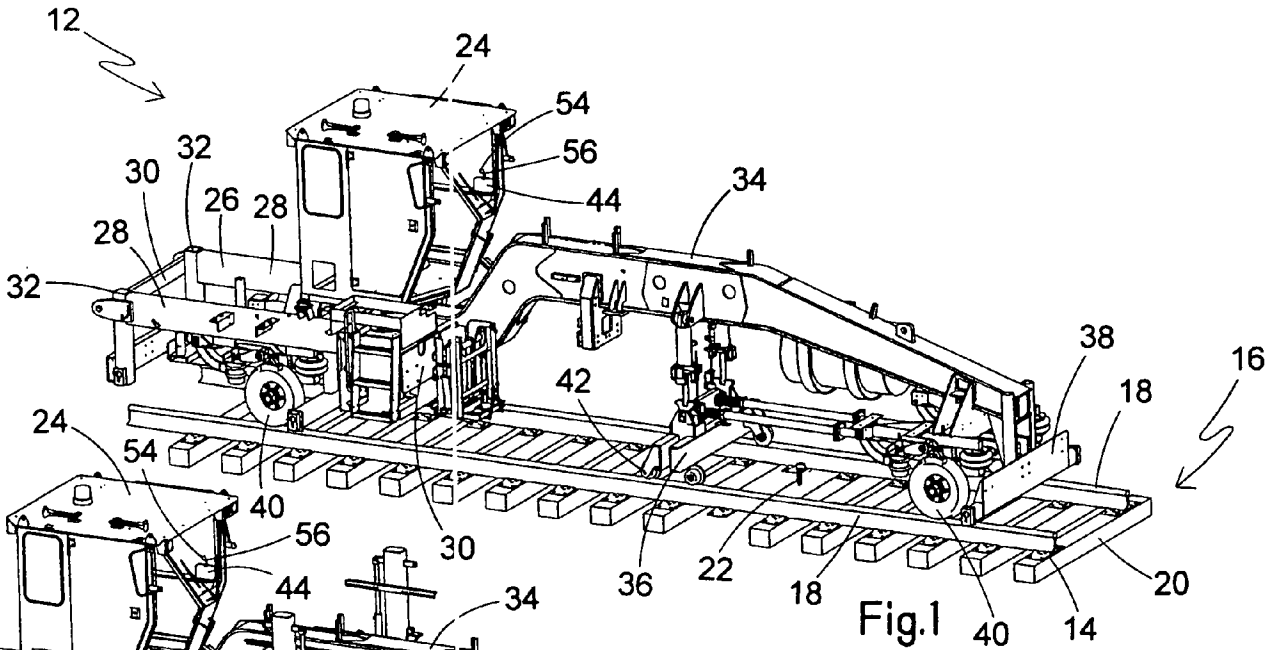
FIG. 1 is a top perspective view of a rail maintenance vehicle of the present plate inserter with the rail lifter workhead shown, and the plate inserter workhead removed.
Figure 2:
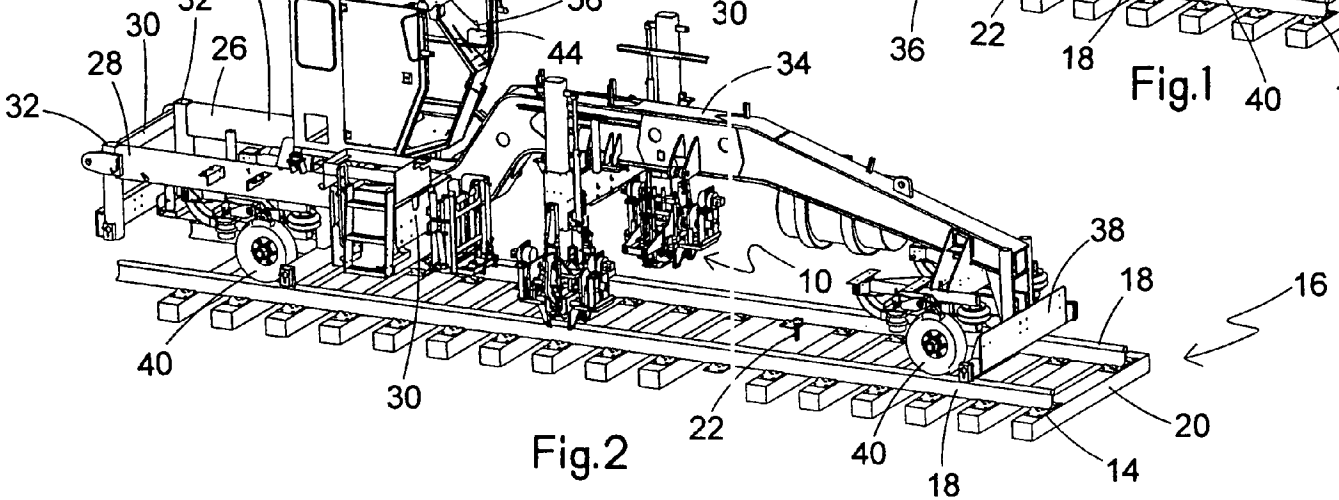
FIG. 2 is a top perspective view of the rail maintenance vehicle of the present plate inserter workhead with the rail lifter workhead removed, and the plate inserter workhead shown.

Referring now to FIGS. 1-2, a railroad plate inserter workhead is generally designated 10, and is specifically disposed on a railway maintenance vehicle, generally designated 12, and designed for use in inserting tie plates 14 onto the railroad track, generally designated 16. The track 16 is made up of a pair of spaced rails 18, which are secured to a plurality of spaced, parallel ties 20 by the tie plates 14. As is well known, the ties 20 are typically wood, but are also made of concrete in some applications. The present application is concerned with track 16 laid upon wooden ties 20, which periodically need replacement due to natural deterioration.

As is known in the art, the tie plates 14 are secured to the ties 20 by spikes 22 or threaded fasteners, here collectively referred to as spikes. Only a few spikes 22 are depicted in FIGS. 1-2 since at that stage of the rail installation or maintenance operation, all of the spikes would be withdrawn from tie plates about to be removed or just inserted. The present railway maintenance vehicle 12 and/or system is designed as a self-propelled unit independently movable along the track 16, having an operator's control station 24 and a power source (not shown) as is known in the art, or alternatively, may be designed for use in a self-propelled or a towed configuration in conjunction with a chain of railway vehicles.

The present railway vehicle 12 includes a minor frame 26 configured for movement relative to the track 16 and provided with a pair of generally parallel side members 28 and a pair of end members 30, which are connected at respective corners 32 to form a generally square or rectangular frame shape. The operator's control station 24 is preferably located on the minor frame 26.

For purposes of describing the present railway vehicle 12, the forward direction is in the direction of travel and the rearward direction is opposite the direction of travel. The vertical direction is transverse to the direction of the track 16, and the horizontal direction is parallel to the direction of the track.

Extending in the forward direction from the minor frame 26 (as defined by the direction of travel), is a major frame 34. The major frame 34 supports the plate inserter workhead 10 and a rail lifter workhead 36, and extends to a front end 38 of the vehicle 12. Preferably, there is one plate inserter workhead 10 on each side of the frame 34 to accommodate each rail 18. Further, each plate inserter workhead 10 can be triggered to operate together or independently of each other.

Preferably, the major frame 34 extends centrally and generally longitudinally along the length of the railway vehicle 12, however other arrangements are contemplated as long as structural support for the components is provided. Rail wheels 40 are rotatably mounted near the front end 38 and at the minor frame 26 to make the vehicle 12 movable along the track 16. Although other locations of rail wheels 40 are contemplated, the wheels are preferably spaced from both the rail lifter workhead 36 and the plate inserter workhead 10.

The rail lifter workhead 36 is preferably positioned rearward from the first set of wheels 40, and forward of the plate inserter workhead 10. The rail lifter workhead 36 preferably has clamps 42 to engage the rail 18 and is configured to hydraulically lift the rail 18 off of the tie 20 and off of the plate 14, as is known in the art. When the rail 18 is lifted, a gap is created between the rail and the tie 20 for the replacement, and a new plate 14 can be inserted between the rail and the tie.

Figure 5:
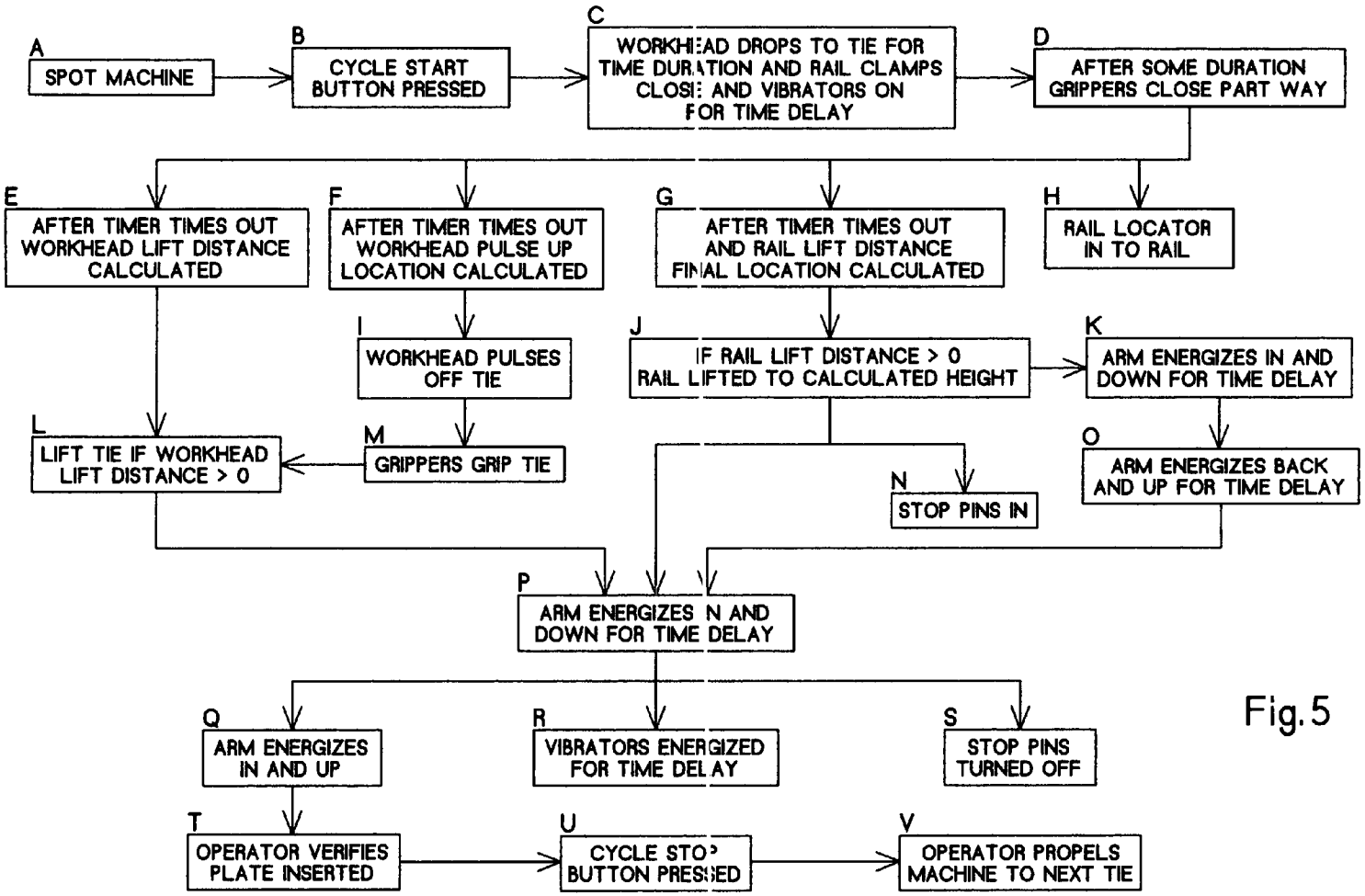
FIG. 5 is a flow chart for the sequence of operation of the railway vehicle.

A flowchart of the preferred process steps of the railway vehicle having a rail inserter 10 is shown in FIG. 5. While the flowchart outlines the preferred process, it should be understood that the order of the steps can be varied, and variations to the steps are contemplated. The preferred process will be described herein.

Referring now to FIGS. 1-5, a control system 44 is used by the operator to spot or position the maintenance vehicle 12 and the plate inserter workhead 10 (step A of FIG. 5). The operator controls the movement of the vehicle 12 over the track 16 until the target tie 20 to which a plate 14 is to be inserted is located. The plate inserter workhead 10 is lowered by virtue of a main cylinder 46 (step C of FIG. 5). The plate inserter workhead 10 includes a locating mechanism 48, a plate-stopping mechanism 50, and a plate pushing assembly 52. The locating mechanism 48 further includes the mechanisms to first center the plate inserter workhead 10 above the tie 20, and second, to center the plate 14 on the tie. A more detailed description of the movement of each component of the plate inserter workhead 10 will be described later.

The control system 44 is used for controlling the workhead centering, the plate centering and the plate pushing operations. Included in the control system 44 is a hydraulic manifold (not shown) which receives the fluid power (preferably hydraulic) from lines which are connected to the various cylinders. The manifold is also connected to a plurality of hydraulic control valves (not shown) which, with the hydraulic lines and the cylinders, form a hydraulic circuit as is well known in the art. While actuation of the various mechanisms is preferably accomplished with hydraulic cylinders, it is contemplated that any type of actuation can be used.

The operator preferably triggers the control system 44 by a button or switch 54 on an operator-manipulated control device 56, preferably a joystick, however other equivalent control units are contemplated. By manipulating the button or switch 54, the operator controls the movement of the locating mechanism 48 and the plate-stopping mechanism 50 (step B of FIG. 5). It will be appreciated that once the plate insertion cycle is initiated, some of the calculations and hydraulically controlled tasks are performed automatically, as is well known in the art.

In operation, the plate inserter workhead 10 moves along the track 16 on the vehicle 12 until the operator locates a tie 20 needing a plate 14 inserted. The various moving components are in their rest or inactive positions. Using the control device 56, the plate inserter workhead 10 is positioned relative to the tie 20 in question so that the tie is located between tie gripping arms 58 of the locating mechanism 48. However, the specific position of the locating mechanism 48 relative to the subject tie 20 may vary slightly with each gripping cycle. Referring now to FIG. 3A, once the locating mechanism 48 is in position, the operator actuates the switch or button 54 to initiate the automatic sequence described below.

Figure 3B:
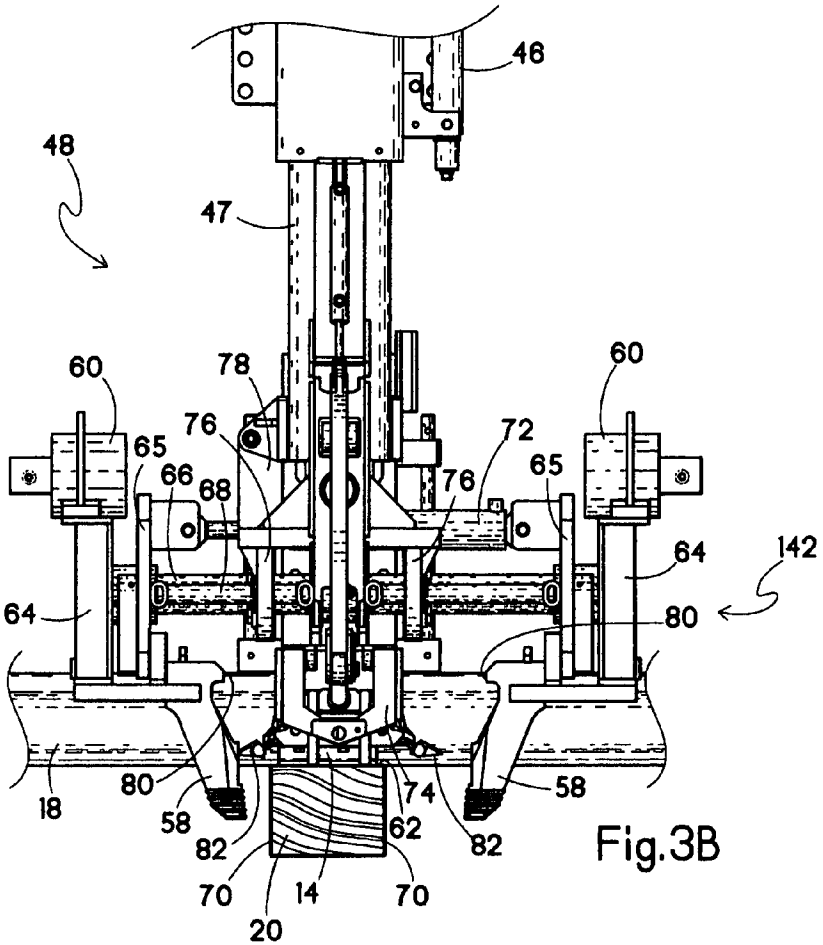
FIGS. 3A-3D are a sequence of side elevations of the plate inserter workhead centering itself above the tie.
Figure 3A:
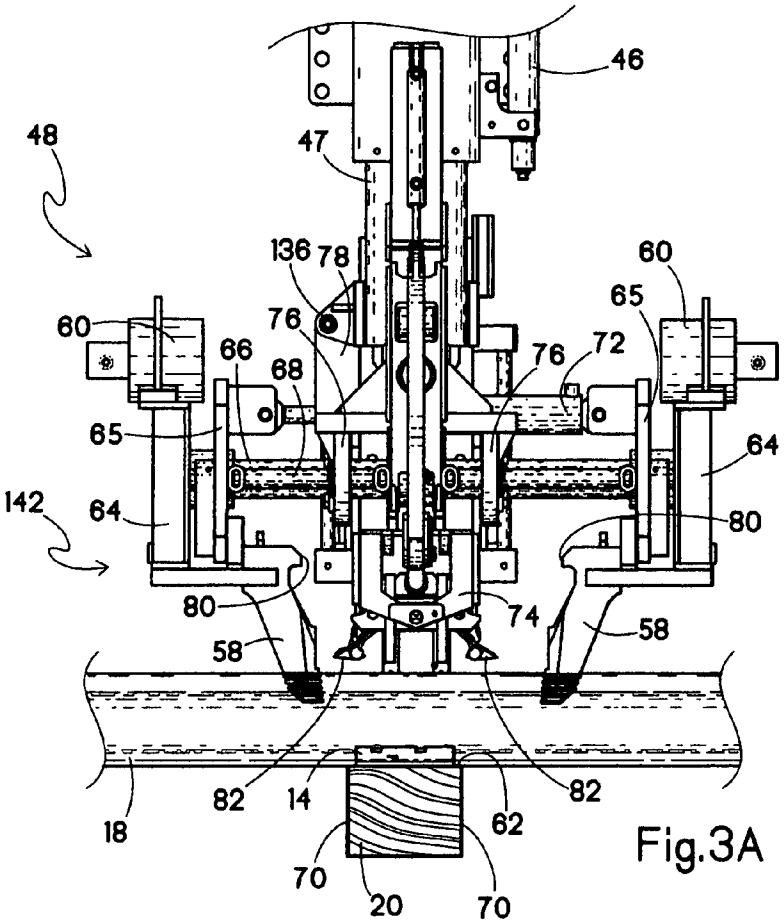
Figure 3D:
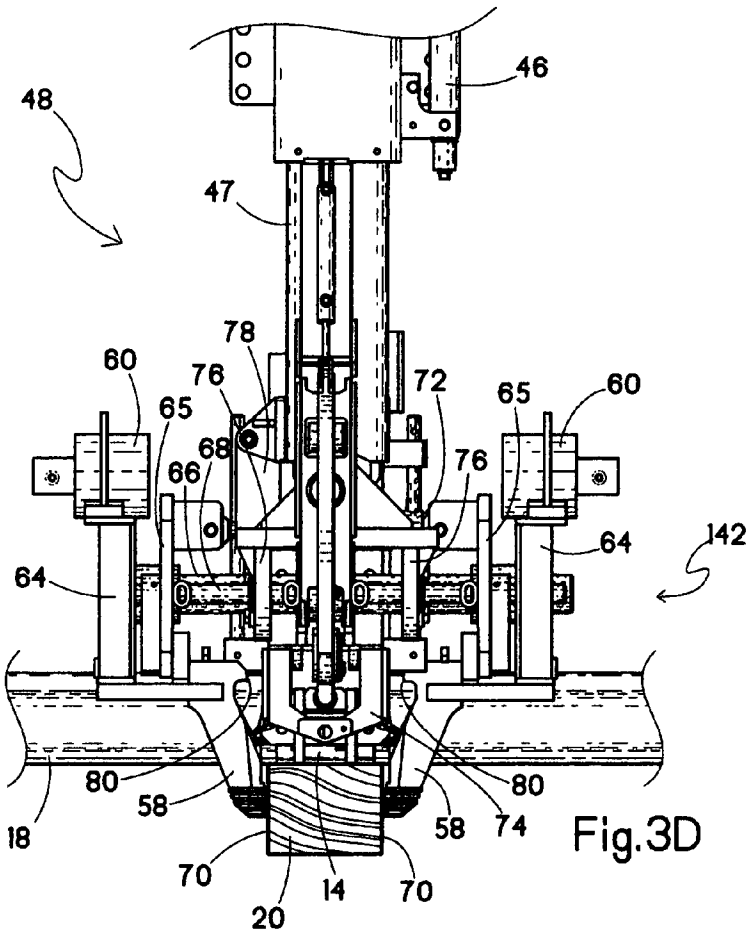

Referring now to FIG. 3B, the locating mechanism 48 is lowered by the main cylinder 46 along a frame member 47 to the tie 20. The locating mechanism 48 includes a workhead-centering mechanism 142 for centering the plate inserter workhead 10 above the tie 20. The locating mechanism 48 preferably includes a vibrator 60 that aids the workhead-centering mechanism 142 in penetrating through ballast on both sides of the tie 20. At least one tie gripper arm 58 extends from a tie gripper support frame 64 that engages a first and a second rod 66, 68 running generally parallel to the rail 18. Preferably, the tie gripper arm 58 is the portion of the workhead-centering mechanism 142 that penetrates the ballast. A second tie gripper support frame 65 is located inside the support frame 64 and also engages the first and second rod 66, 68.

Preferably, there are at least two tie gripper arms 58 which move toward each other as they slide along the first and second rods 66, 68 (step D of FIG. 5). In the preferred embodiment, there are eight gripper arms 58 spaced along the locating mechanism 48, and specifically, there are preferably four gripper arms 58 configured to be located on each side of the tie 20. As the tie gripper arms 58 move towards each other, they converge on side surfaces 70 of the tie 20. A tie grip cylinder 72 provides hydraulic pressure to slide the support frame 64 along the first and second rods 66, 68 to converge the tie gripper arms 58.

Figure 3C:
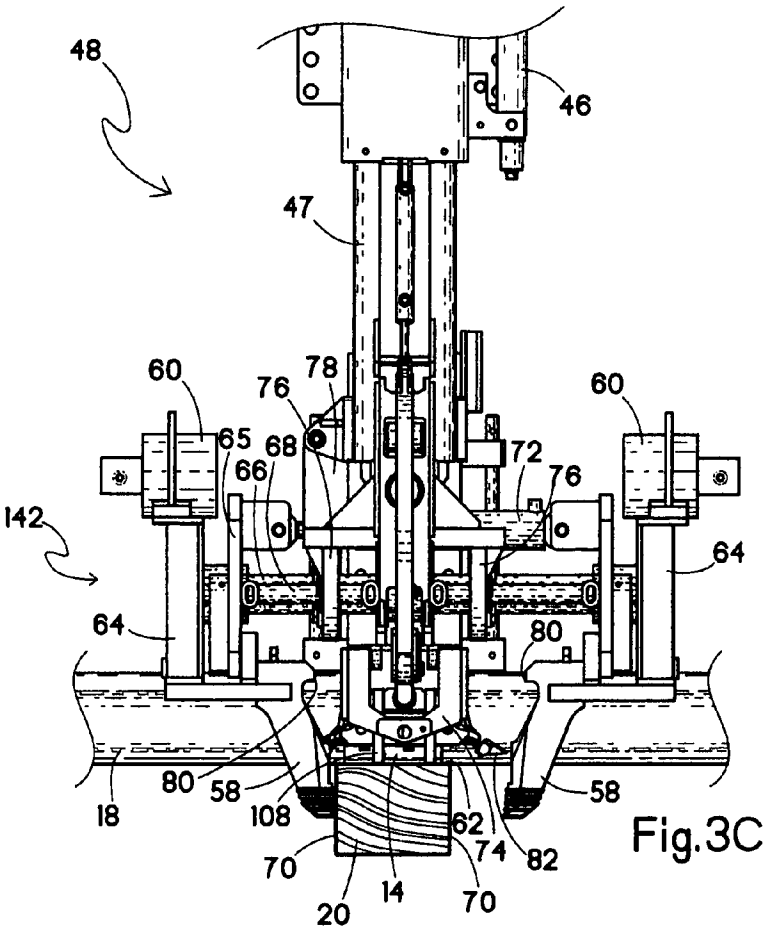

Depending on the relative location of the locating mechanism 48 to the tie 20, one or more tie gripper arms 58 may converge on and engage the side surface 70 of the tie and the plate 14 before other tie gripper arms. In FIG. 3C, the left side tie gripper arms 58 engage the tie 20 and the plate 14, while the right side gripper arms continue to move toward the tie and the plate. Eventually, both sides of the tie gripper arms 58 will converge on the tie 20. When the tie gripper arms have converged on the tie 20, the plate inserter workhead 10 is preferably centered above the tie. In operation, this procedure is performed quickly, preferably within seconds.

At the inner portion of the locating mechanism 48 is a plate-centering mechanism 74 that is movable parallel to the direction of the rail 18 and within an area bounded by a collar 76 disposed around rods 66, 68. With this construction, the plate-centering mechanism 74 is positionable with respect to a plate centering housing 78 and over the top surface 62 of the tie 20. The plate-centering mechanism 74 is positioned over the top surface 62 of the tie 20 by a contact point 80 on the tie gripper arm 58. As the tie gripper arms 58 converge towards the tie 20, the contact point 80 engages the plate-centering mechanism 74 and takes up any misalignment until the plate-centering mechanism and the tie gripper arms are centered above the tie.

At least one, but preferably multiple centering fingers 82 (FIG. 3A) are disposed on the plate-centering mechanism 74 of the locating mechanism 48. The centering fingers 82 are spring-loaded and shaped to capture the plate 14 within the plate-centering mechanism 74 as the centering fingers descend towards the tie 20, and as the tie gripper arms 58 converge towards the side surfaces 70 of the tie 20. In this configuration, the spring-loaded centering fingers 82 take up misalignment of the plate 14 on the tie 20 as the plate is pushed along the tie. When both sides of the tie gripper arms 58 engage the tie 20, the plate-centering mechanism 74 of the locating mechanism 48 should be centered above the plate 14, and the plate should be centered on the tie.

Figure 4B:
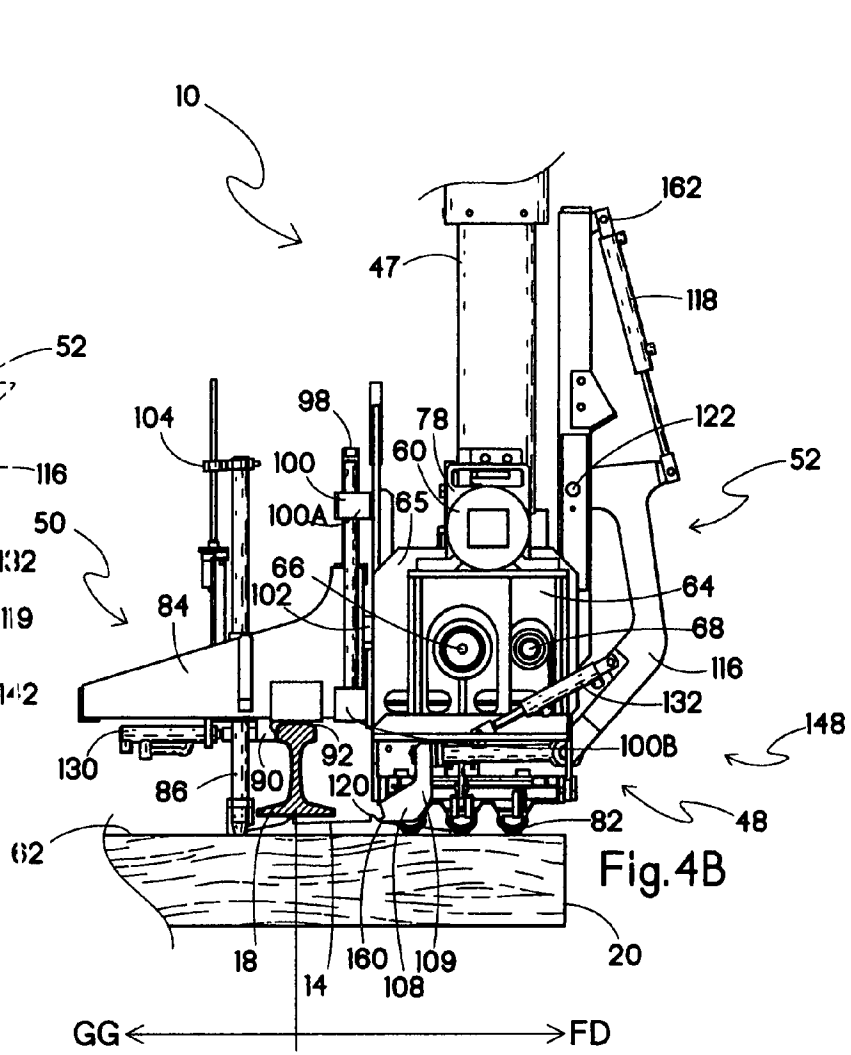
FIGS. 4A-4F are a sequence of front elevations of a plate pushing assembly and a plate-stopping mechanism positioning a plate into position under a rail.
Figure 4A:
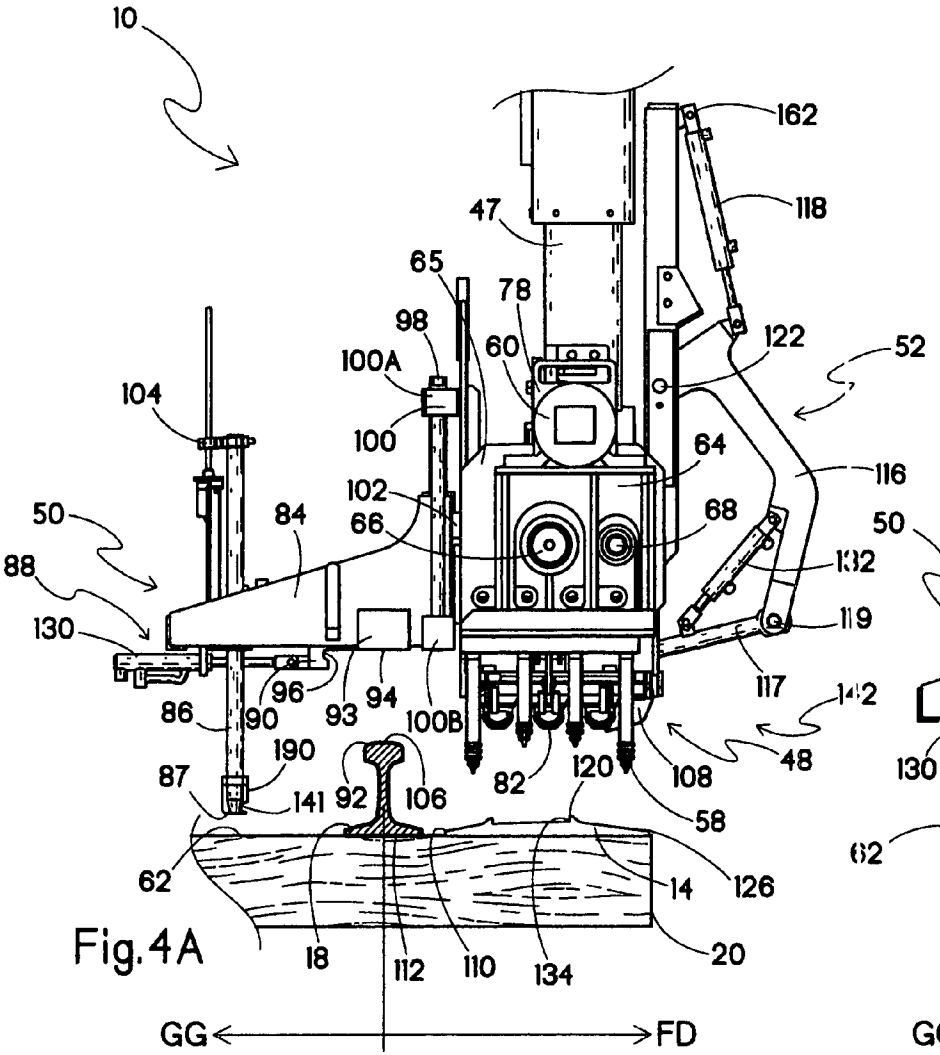

Referring now to FIGS. 4A-4F, preferably simultaneously with the descending of the locating mechanism 48, the control system 44 causes the plate-stopping mechanism 50 to descend. In FIG. 4A, the plate inserter workhead 10 is in the ready position above the tie 20, and in FIG. 4B, the plate inserter workhead is descended to the tie.

In FIG. 4B, the plate-stopping mechanism 50 descends until a plate stop housing 84 engages the rail 18. When the plate stop housing 84 impacts the rail 18, stop pins 86, located at the gage side GG of the rail and operatively connected to the plate stop housing 84, should also impact the tie, either at the same time or very close in time. A rail locator 90 is disposed adjacent the bottom edge of the plate stop housing 84, and is movable parallel to the tie 20.

Figure 4D:
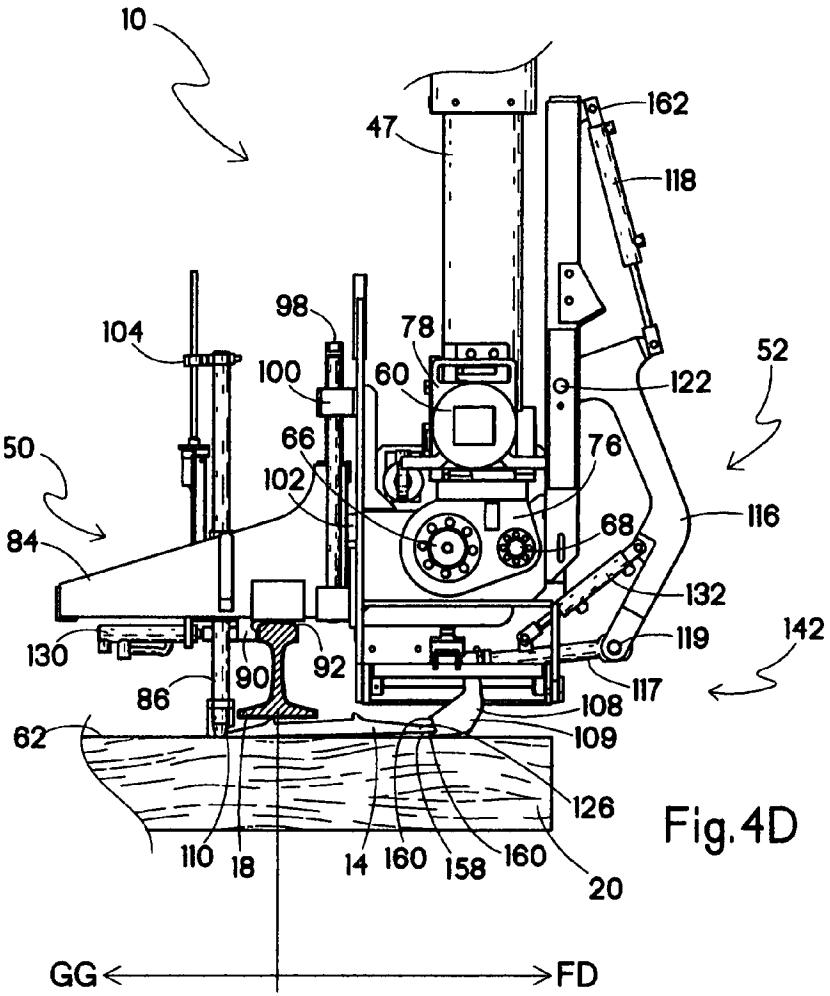
Figure 4C:
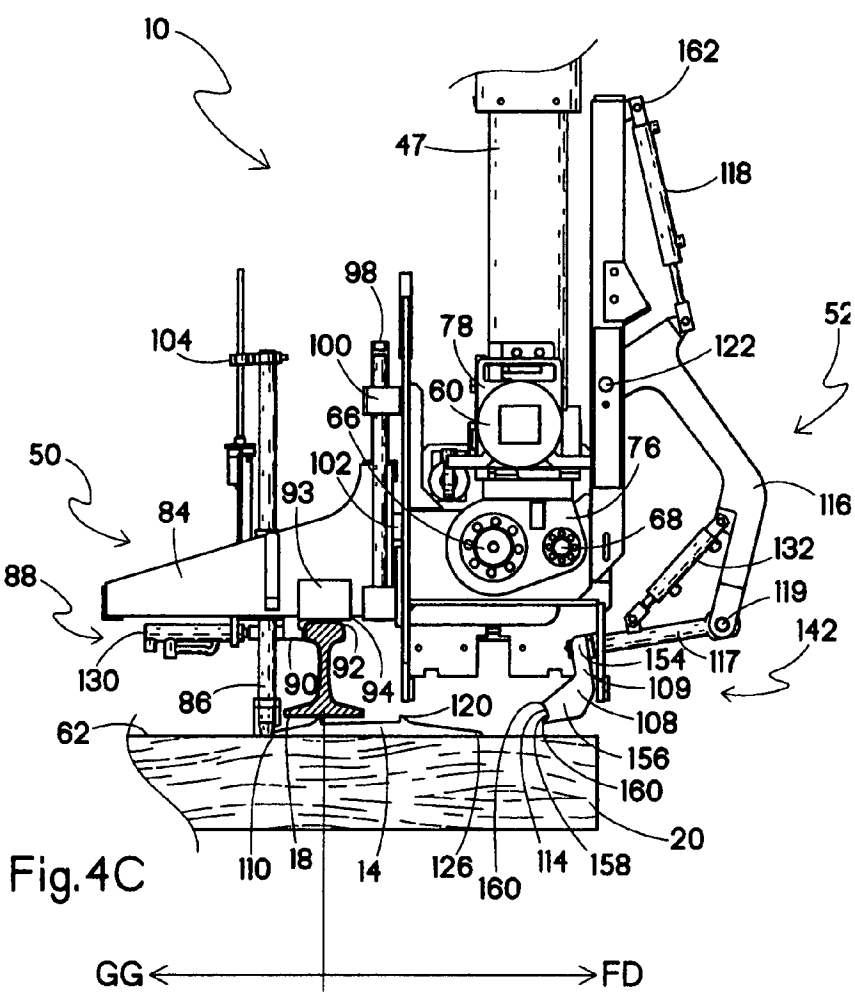
Figure 4F:
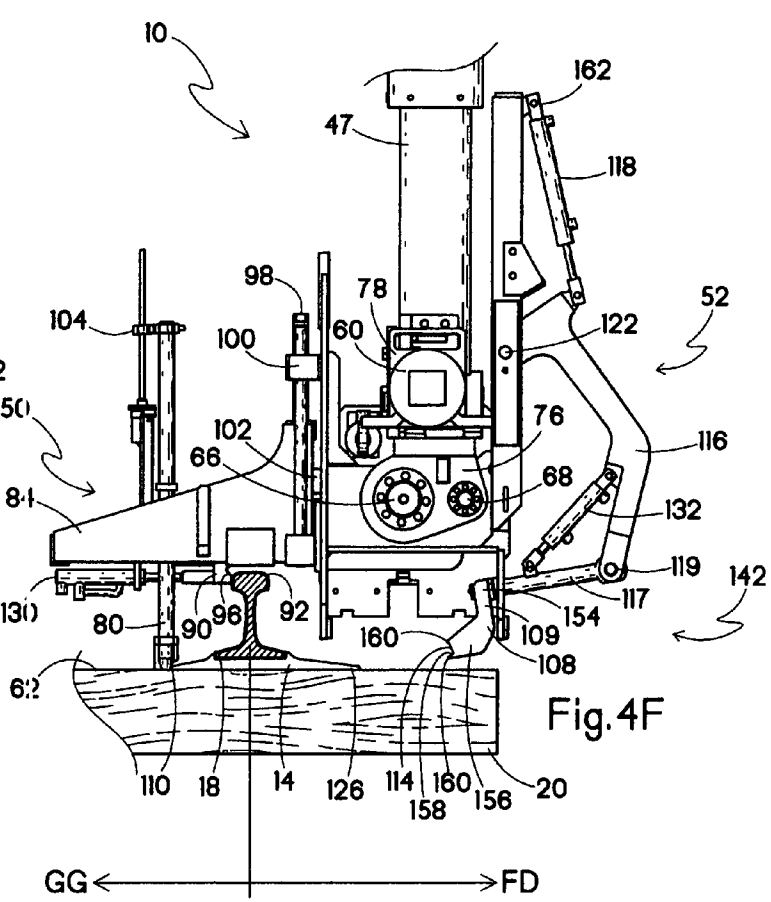
Figure 4E:
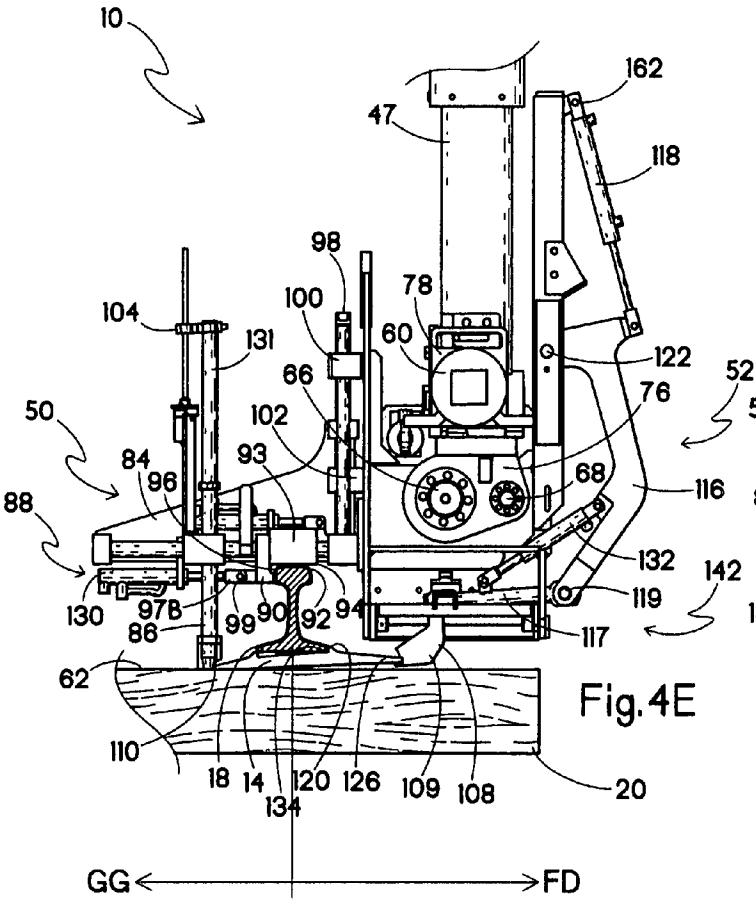
Figure 16:
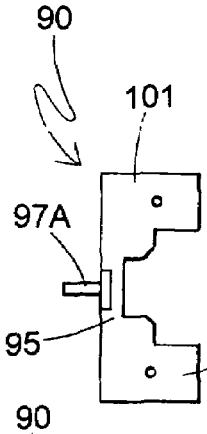
FIG. 16 is a top view of a rail locator.
Figure 17:
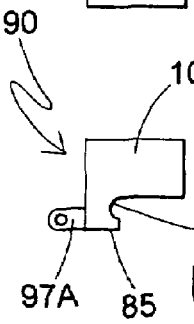
FIG. 17 is a side elevation of the rail locator of FIG. 16.

Referring now to FIGS. 4E, 16 and 17, the rail locator 90 includes a first portion 95 having an attachment formation 97A for linking the rail locator to a corresponding attachment formation 97B on the plate-stopping mechanism 50. In the preferred embodiment, a pin 99 fastens the attachment formations 97A and 97B together.

Extending generally perpendicularly in the horizontal direction from the first portion 95 is at least one, and preferably two contact bodies 101. The contact bodies 101 are preferably integral with the first portion 95, but can also be attached to the first portion. A recess 96 is located in the contact body 101 at a lower surface 85 of the contact body. The lower surface 85 is configured to engage a side surface of the rail ball 92 (step H of FIG. 5). The recess 96 is configured to accommodate a plurality of rail ball 92 shapes and sizes since rails can be provided in different shapes and sizes, and further, the rail material can flow from repeated use, causing the rail ball to become misshapen. In the preferred embodiment, the rail locator 90 is provided with an abrasion-resistant coating, such as by flame spraying a metal particulate. As seen in FIG. 4E, a secondary rail locator surface 93 is preferably provided at the bottom edge of the plate stop housing 84. The secondary rail locator surface 93 is configured to engage a top surface 106 of the rail ball 92. Together, the secondary rail locator surface 93 and the lower surface 85 of the contact body cooperate to positively locate the rail ball 92 with respect to the plate inserter workhead 10.

A stop pin assembly 88 (best seen in FIGS. 4E and 6), which operatively connects the stop pins 86 to the plate stop housing 84, is moved along the top surface 62 of the tie 20 toward the gage side GG of the rail 14. The motion of the stop pins 86 may be dependent or independent of the motion of the rail locator 90. At least one, but preferably a plurality of stop pins 86 on the stop pin assembly 88 move vertically with respect to the plate stop housing 84, and move horizontally along the length of the plate stop housing (as will be discussed in greater detail later). The stop pins 86 move towards the rail 18 along the length of the tie 20 until they are a measured distance from the rail (step N of FIG. 5).

As discussed with respect to the locating mechanism 48, the plate pusher assembly 52 descends until the locating mechanism impacts the tie 20 or the tie plates 14. Since the plate-stopping mechanism 50 descends until it impacts the rail 18, and the locating mechanism 48 descends until it impacts the tie 20 or tie plate 14, the two workheads are movable with respect to each other. The plate centering housing 78 is slidable relative to the plate stop housing 84 by virtue of a relative plate stop rod 98, cuff 100 and slide block 102 arrangement on opposing surfaces of the plate stop housing and plate centering housing. Specifically, if the plate-stopping mechanism 50 engages the rail 18 first, the locating mechanism 48 will continue to descend, its cuffs 100A sliding down the plate stop rod 98, and the cuffs 100B of the plate stop housing 84 sliding along the slide block 102. In this way, the locating mechanism 48 and the plate pusher assembly 52 continue to descend until the locating mechanism impacts the tie 20 or the tie plates 14.

At this point, the gap distance between the rail 18 and the tie 20 is measured by the linear variable displacement transducer ("LVDT"), or any other known measuring device 104 (steps E-H of FIG. 5). From this measurement, various calculations can be made. For example, the locating mechanism 48 lift distance, the tie 20 lift distance, and the rail 18 lift distance, if required. If the distance is less than a predetermined value or range of values, the rail 18 is lifted (steps G, J). If the distance is greater than a predetermined value or range of values, the tie 20 is lifted toward the rail 18 (steps E, F, I, M, L). Both operational sequences will be described below.

Through the use of an operator controlled potentiometer (not shown) located in the operator's control station 24, the predetermined gap distance is set. It is desirable to have about a 2-inch gap between the rail and the tie. The operator dials in an amount, preferably once per day. In the preferred embodiment, the threshold value or range of values is about 1-2 inches, however this value or range of values will vary depending on track type and condition.

The gap distance is calculated using the height of the rail 18 (manually measured by the operator), which is subtracted from the total vertical distance of the bottom surface 94 of rail locator 90 from the tie 20. The total vertical distance of the bottom surface 94 from the rail 18 is measured by the LVDT 104. In the preferred embodiment, the LVDT 104 is located on the plate-stopping mechanism 50. Assuming the gap distance is below the threshold range, the rail 18 will be lifted by the rail lifter workhead 36 provided on the major frame 34 until the predetermined gap distance is attained (steps G, J). Assuming the gap distance is above the threshold value, the tie gripper arms 58 will lift the tie 20 until the predetermined gap distance is attained steps E, F, I, M, L). If the gap distance is within the threshold range, neither the tie 20 nor the rail 18 will be lifted.

When the rail 18 is lifted by the rail lifter workhead 36 to obtain the predetermined gap between the rail and the tie 20, the rail in turn lifts the plate-stopping mechanism 50. The plate-stopping mechanism 50 is raised with the rail 18 because the plate stop housing 84 engages the rail at an upper surface 106 of the rail, so when the rail is lifted, the plate-stopping mechanism 50 is lifted with it. However, the stop pins 86 do not ascend with the plate-stopping mechanism 50, but preferably remain engaged on the tie 20 (step M of FIG. 5).

The plate 14 is positioned under the rail 18 by a plate pusher 108 sliding the plate along the tie 20, and pivoting the plate about a leading edge 110 of the plate (steps K, O, P, Q of FIG. 5). In the preferred embodiment, the plate pusher 108 positions the plate 14 in two stokes. The first stroke pushes the plate 14 along the tie 20 (step K, O of FIG. 5), and the second stroke pivots the plate into engagement with a lower portion 112 of the rail (step P, Q of FIG. 5).

Before the initial stroke, the locating mechanism 48 lifts off the tie 20 to provide the pusher assembly 52 with additional space to cycle, however, other configurations are contemplated. When the locating mechanism 48 ascends off the tie 20, the cuffs 100A slide up the plate stop rod 98, while the plate-stopping mechanism 50 preferably does not move.

Figure 11:
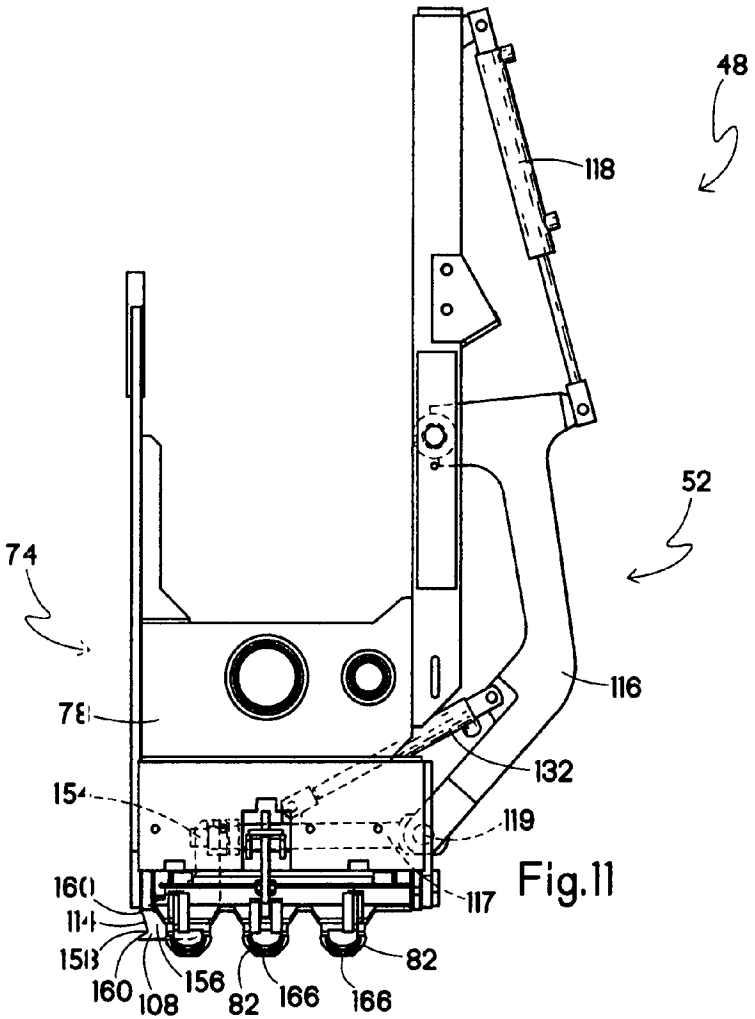
FIG. 11 is a front elevation of the plate-centering mechanism and the plate pushing assembly.

As seen in FIGS. 4C-4D and 11, the plate pusher 108 preferably includes an engaging formation 114 which is configured to engage the plate 14. The motion of the plate pusher 108 is generally along the bottom of the locating mechanism 48. A pusher arm 116 and a main pusher cylinder 118 are preferably located to the field-side FD of the locating mechanism 48. The extension of the main pusher cylinder 118 causes the dog-leg shaped pusher arm 116 to place the plate pusher 108 in engagement with a field-side shoulder 120 of the plate 14.

Figure 18:
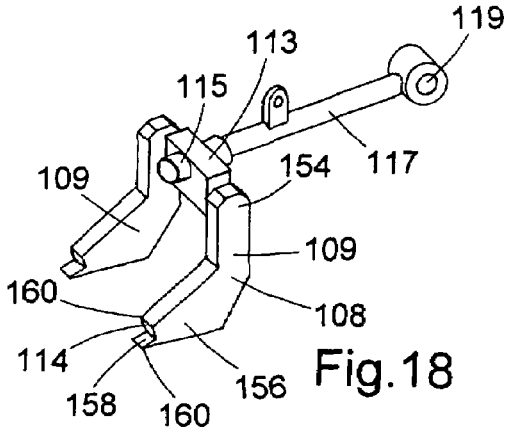
FIG. 18 is a perspective view of a plate pusher.

Referring now to FIG. 18, the plate pusher 108 has a first portion 113 including an attachment formation 115 for linking the plate pusher to a plate pusher arm 117. At least one contact body 109 is attached to or is integral with the first portion 113, and the contact body extends generally transverse to the first portion in the vertical direction. A distal end 156 on the contact body 109 is offset in the vertical direction from the attachment formation 115. The distal end 156 includes the engaging formation 114 configured to engage the plate. By extending, the main pusher cylinder 118 causes the plate pusher 108 to pivot about a pivot point 122 to push the plate 14 along the surface 62 of the tie 20 until it is as close as possible to the rail base, or in the alternative (if the rail is sufficiently raised above the tie), until the end of the pusher assembly 52 stroke or until the plate 14 engages the stop pins 86 (See FIG. 4B). The length of the stroke of the plate pusher 108 is predetermined through the dimensions of the pusher arm 116 and the length of the cylinder arms 118, 132.

During the initial stroke, as the plate 14 is pushed across the tie 20, the locating mechanism 48, through its plurality of spring-biased centering fingers 82, centers the plate 14 on the tie 20, since the plate-centering mechanism 74 of the locating mechanism is pivotable on the plate centering housing 78. In the preferred embodiment, the pusher arm 116 performs the initial stroke until a timer times out the stroke. When the stroke is timed out, the pusher arm 116 retracts (FIG. 4C) (Step O of FIG. 5).

The lifting of the rail 18 or the tie 20 depending on the measured gap, as explained above, preferably occurs before the first stroke of the plate pusher 108, but alternatively, can occur between the first stroke and the second stroke. The dimensions of the pusher arm 116 and the extensions of the cylinder arms 118, 132 dictate the geometry of the stroke and whether lifting is desirable before or after the first stroke. Whichever order the lifting occurs, it is important for the predetermined gap to be established between the rail 18 and the tie 20 before the second stroke because the plate 14 must be positioned between the plate and the tie during the second stroke.

As seen in FIG. 4D, upon retracting the plate pusher 108 from the first stroke, the plate pusher performs a second stroke (Step P of FIG. 5). This time, the plate pusher 108 engages a trailing edge 126 of the plate 14. As the plate 14 is pushed under the rail 18, the leading edge 110 of the plate impacts the stop pins 86 which are positioned near the gage side of the rail. The vibrators 60 can be energized to help the pushing motion of the plate 14 along the tie 20 (step R of FIG. 5). A continued pushing stroke from the pusher arm 116, working against the pressure of at least one stop pin cylinder 130, causes the plate 14 to elevate at the trailing edge 126.

In the preferred embodiment, this elevation is assisted by the vertical elevation of the pusher arm 116 caused by the supplemental pusher cylinder 132 retracting. It is also preferred that pressure to the stop pins 86 is cut off at this point, and the residual pressure and friction in the stop pin system provides sufficient resistance to the pusher arm 116 to cause the desired elevation (step S of FIG. 5). Under the pressure exerted from the pusher arm 116, the stop pins 86 retract away from the rail 18 along the length of the tie 20.

As the plate 14 is elevated, the pusher arm 116 continues its second stroke and moves the elevated plate closer to the rail 14. Eventually, the inside edge of the field side shoulder 120, (or the inside of the rail base channel) is placed in contact with the lower portion 112 of the rail 18 (FIG. 4E). In this manner, proper alignment is achieved between the rail 18 and the tie plate 14 regardless of the size and shape of the tie plate channel.

In prior art plate inserters, a variation in the size of the plate length can cause the rail 18 and the plate 14 to not engage. Plates 14 can vary in size and shape on a track 16, particularly at curves in the track. When variation in the plates 14 occurs, the prior art inserters required that the stop pins 86 be readjusted. Thus, by engaging a bottom portion of the rail directly into the plate channel, a problem of prior plate placing devices has been overcome without having to readjust the stop pins 86.

Once the plate 14 is engaged on the rail base, the operator notes the engagement and releases pressure on the system by manipulating the switch 54 (steps Q, T, U of FIG. 5). Alternately, the pressure can be released by action of a pressure sensor connected to the pusher arm main cylinder 118, a timer, or other mechanisms known in the art. The plate pusher 108 retracts and the plate 14 is placed onto the tie 20 at the location of engagement with the rail 18. Additionally, upon release of the pressure, the rail lifter workhead 36 releases the rail 18 onto the plate 14, so that it assumes its prior position, now engaged upon the newly inserted plate.

Preferably, both the plate-stopping mechanism 50 and the locating mechanism 48 ascend and resume their rest position. The plate pusher assembly 52 is also drawn back towards the field side into its initial position. When the plate-stopping mechanism 50, the locating mechanism 48 and the plate pushing assembly 52 are sufficiently retracted, the operator can move the vehicle 12 to the next tie 20 (step V of FIG. 5).

In the situation where the measured distance is greater than the threshold value or range of values, this signifies that the tie 20 is lower than desired and must be pulled upward towards the rail 18 to place the plate 14. Ties 20 often are unusually low in the ballast due to factors involved in the tie insertion process, well known to skilled practitioners.

After the control system 44 makes the calculation, upon the engagement of the plate-stopping mechanism 50 and the locating mechanism 48 with the rail 18 and the tie 20, respectively, the tie gripper 58 arms engage the tie. The main cylinder 46 is retracted to raise the tie gripper arms 58 and the tie 20 until the LVDT or other measuring device 104 indicates that the appropriate height has been achieved. When the appropriate height has been achieved, the appropriate predetermined gap exists between the tie 20 and the rail 18. Then the first stroke is initiated by the pusher arm 116, as in the first example. At the end of the stroke 14, the plate is in close proximity to the rail base, which is raised above the tie 20.

According to the preprogrammed cycle, the pusher arm 116 begins its second stroke, pushing the plate 14 against the stop pins 86. Continued extension of the pusher arm 116 against the stop pins 86 moves the pins backwards, but also causes the plate 14 to elevate at the trailing edge 126, as in the first example. Further movement of the pusher arm 116 places the field side plate shoulder 120 in engagement with the rail base as described above. In both examples, the pushing assembly 52 both pushes and pivots the plate 14 against the backpressure of the stop pins 86.

In the event the operator tries to move the vehicle 12 during the operational cycle, the system is configured to release all pressure to prevent damage to the mechanisms. Further, in the event the vehicle 12 encounters an obstacle on the track 16, shear pins 136 are located on the plate inserter workhead 10 to permit the workheads 48, 50 to shear off at a calculated location to minimize damage (See FIGS. 3A and 9).

Figure 7:
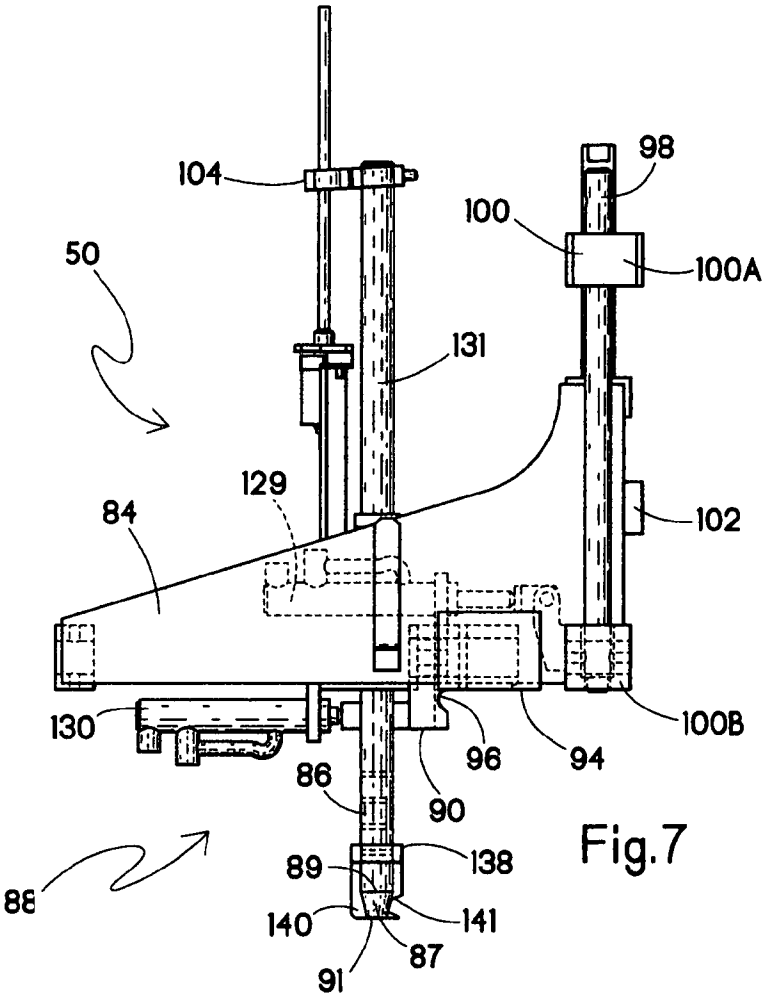
FIG. 7 is a front elevation of the plate-stopping mechanism.
Figure 6:
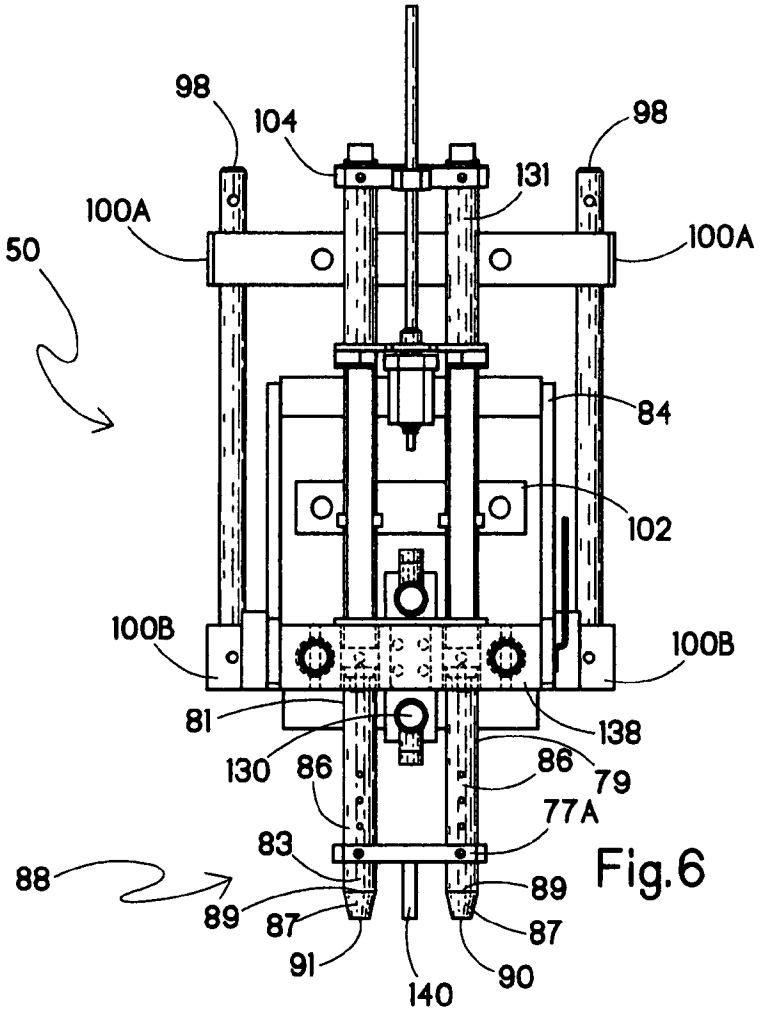
FIG. 6 is a side elevation of the plate-stopping mechanism.

Referring now to FIGS. 6 and 7, the stop pin assembly 88 will be described in more detail. The stop pin assembly 88 preferably includes at least two of the stop pins 86 and a bridging bracket 138, and a locator tool 140. The bracket 138 extends between the two stop pins 86 and is preferably spring loaded so that if one pin hits the tie 20 and the other does not, the non-contacting pin will not be drastically out of alignment with the other. It is important that the pins 86 be generally aligned because the alignment of the plate 14 is determined by the alignment of the pins.

Figure 13:
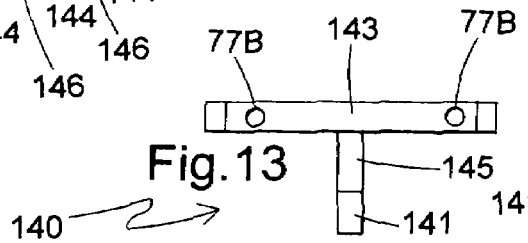
FIG. 13 is a front elevation of a locator tool.
Figure 14:
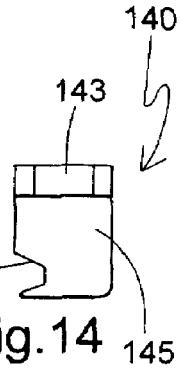
FIG. 14 is a side elevation of the locator tool of FIG. 13.
Figure 15:
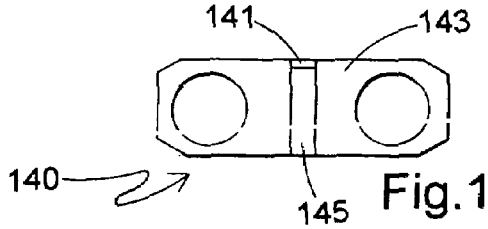
FIG. 15 is a bottom view of the locator tool of FIG. 13.

The stop pin 86 includes an elongate member 79 having a first end 81 operatively attached to the plate inserter workhead 10, and a distal end 83 opposite of the first end. Each stop pin 86 preferably has a tip 87 which has a first end 89 that is attached to the distal end 83 of the stop pin 86, and a second end 91 that engages the tie 20. Each stop pin 86 includes at least one attachment structure 77A disposed on the elongate member 79 configured for receiving a corresponding attachment structure 77B of a locator tool 140 (FIG. 13). In the preferred embodiment, the attachment structure 77A is a hole configured to receive a fastener.

As seen in FIGS. 7 and 13-15, the locator tool 140 preferably includes an extension portion 143 extending between the stop pins 86. The extension portion 143 preferably includes the least one attachment structure 77B which is configured to engage the corresponding attachment structure 77A on the stop pins 86. The locator tool 140 also includes a receiving portion 145, which is preferably either attached to or integral with the extension portion 143. The receiving portion 145 includes a receiving formation 141 configured to receive a leading edge 110 of a plate 14 and to permit the leading edge to pivot within the receiving formation (FIG. 4B). While the receiving formation 141 is preferably an indentation in the face of the locating tool 140, other configurations of receiving formation are contemplated. Further, other configurations of locator tools 140 configured to be attached to the stop pins 86 are also contemplated.

The stop pins 86 are controlled by multiple cylinders. The main cylinder 46 controls the vertical movement of the plate-stopping mechanism 50 as the stop pins 86 descend until they contact the tie 20. The stop pin cylinder 130 prevents or permits the movement of the stop pins 86 relative to the rail locator 90 in the horizontal direction when the plate 14 is inserted. In the preferred embodiment, a third cylinder 129 is located generally parallel to and in opposing orientation to the stop pin cylinder 130. Together, the third cylinder 129 and the stop pin cylinder 130 position the stop pin assembly 88 near the rail 14. Preferably, the stop pin cylinder 130 and the third cylinder 129 cooperate to engage the recess 96 of the rail locator 90 with the side surface of the rail ball, and to engage the bottom edge 94 of the rail locator with the top surface of the rail ball. However, the number and arrangements of cylinders can vary. An upper portion 131 of the stop pins 86 works in conjunction with the LVDT 104 (or other measuring device) to measure the gap distance between the rail 18 and the tie 20 by measuring the distance between the tie and the bottom contacting surface 94 of the rail locator 90, and subtracting the known height of the rail.

Figure 8:
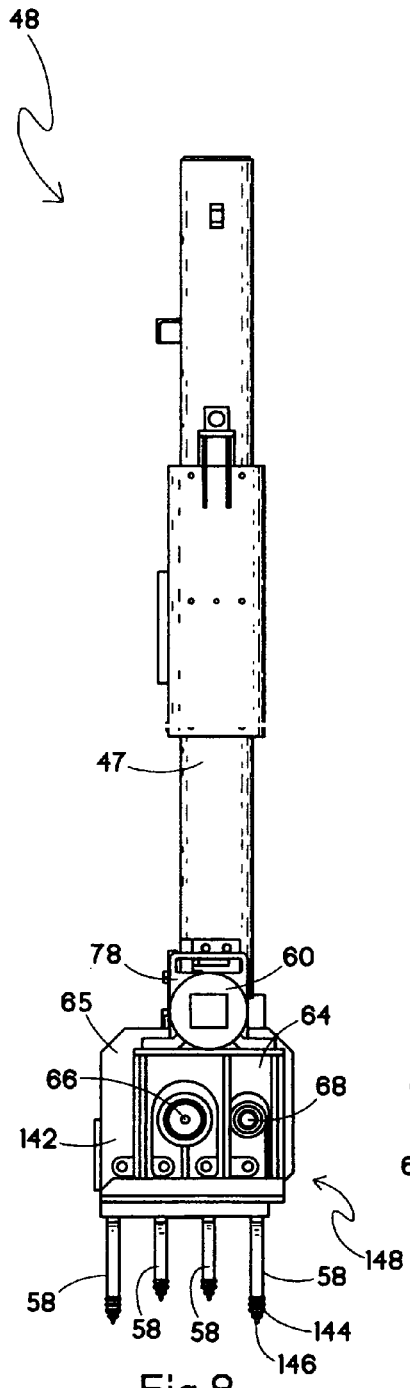
FIG. 8 is a front elevation of a workhead-centering mechanism for centering the rail inserter workhead above the tie.
Figure 9:
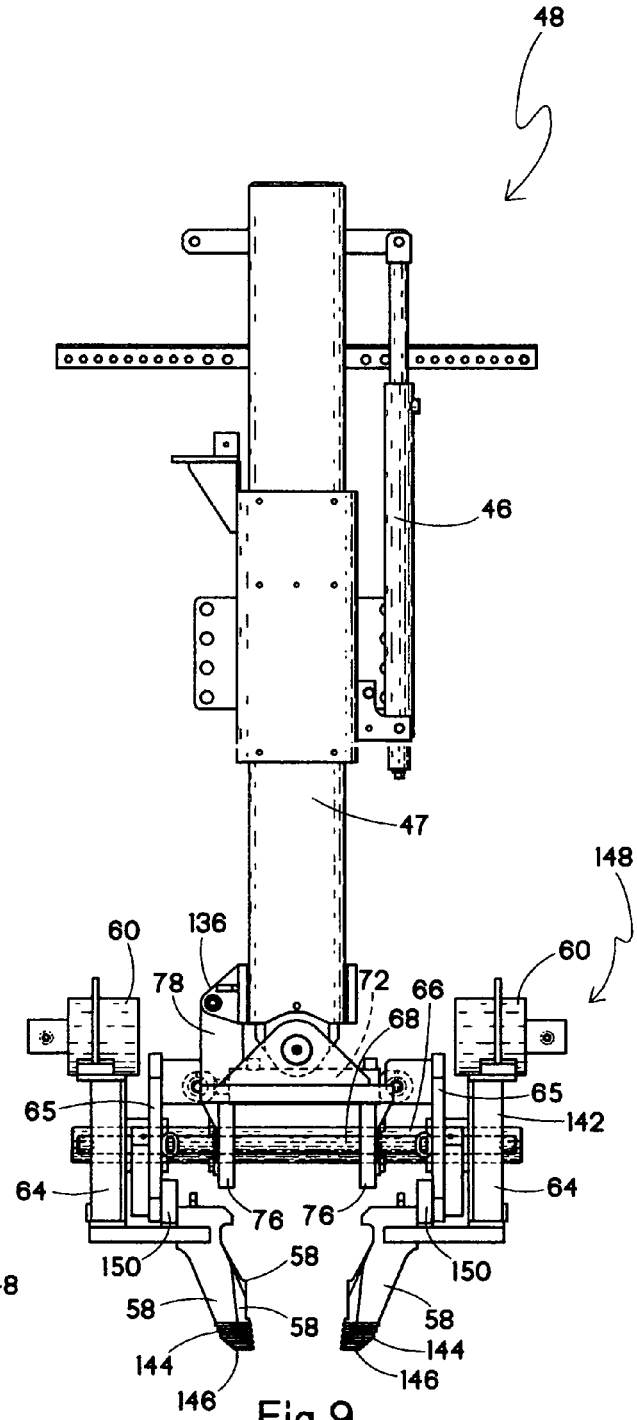
FIG. 9 is a side elevation of the workhead-centering mechanism for centering the rail inserter workhead above the tie.
Figure 12:
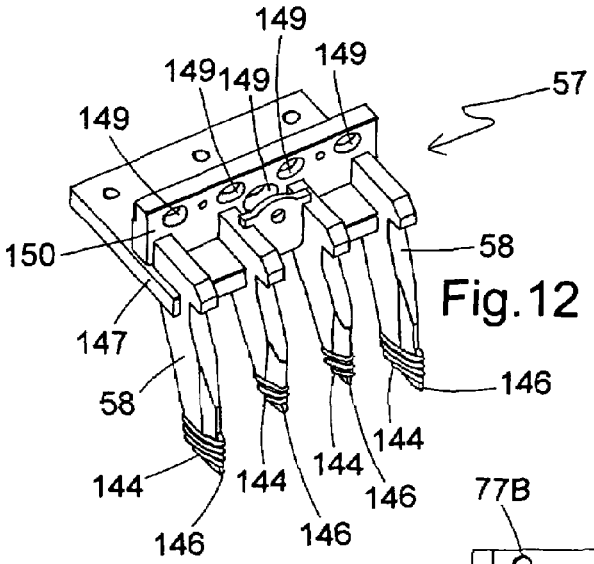
FIG. 12 is a perspective view of a tie gripper arm assembly.

The workhead-centering mechanism 142 of the locating mechanism 48 is shown in FIGS. 8 and 9, and a tie gripper arm assembly 57 is shown in FIG. 12. The tie gripper arms 58 preferably have a gripping formation 144 disposed on a distal end 146 of each arm for gripping the tie 20. In the preferred embodiment, the gripping formation 144 are a series of ridges, but other configurations are contemplated.

Figure 10:
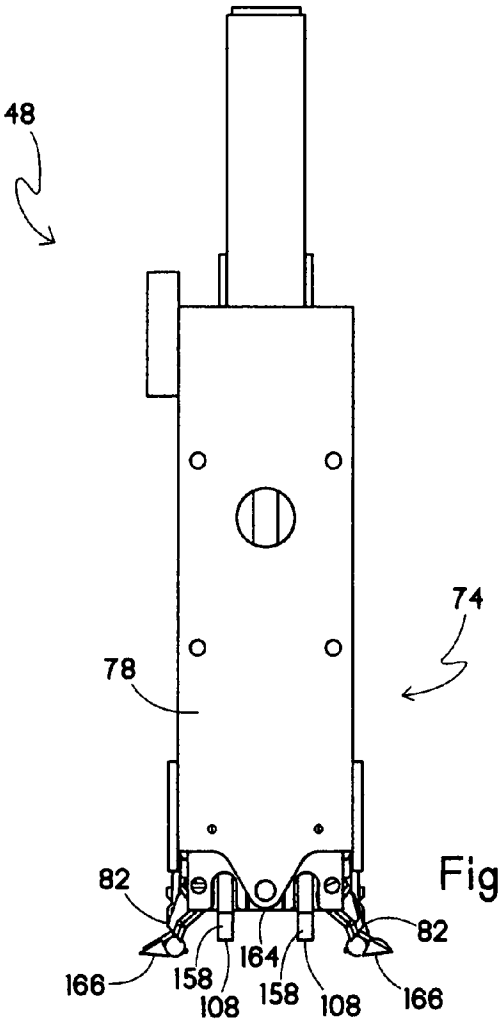
FIG. 10 is a side elevation of a plate-centering mechanism and the plate pushing assembly.

The tie gripper arms 58 are attached to the first and second rods 66, 68 by a gripper mount assembly 148. A bolt mount portion 150 attaches the gripper arms 58 to support frames 65. The support frames 65 move closer or further away from each other with the retraction or extension of the tie grip cylinder 72, respectively. Referring now to FIG. 12, the tie gripper arm assembly 57 includes the at least one tie gripper arm 58 extending in a first direction, generally vertically. A second portion 147 is attached to the tie gripper arm 58 and is generally perpendicular to the tie gripper arm. Preferably, the second portion 147 is a structural member that attaches a plurality of tie gripper arms 58 together. The bolt mount portion 150 is attached to either the second portion 147 or the tie gripper arms 58, or both. The bolt mount portion 150 has at least one attachment formation 149 configured to be attached to the workhead-centering mechanism 48 for reciprocating the tie gripper arm assembly 57 parallel to the rail 14. In FIGS. 10 and 11, the plate-centering mechanism 74 of the locating mechanism 48 is shown. The plate-centering mechanism 74 is mounted inside the workhead centering portion 142 of the locating mechanism 48, as seen in FIG. 4. Additionally, the plate pusher assembly 52 is shown in FIG. 11, portions shown in phantom.

As seen in FIGS. 4C, 11 and 18, the plate pusher 108 has a first portion 154 linked to the pusher arm 116. The first portion 154 is preferably directly coupled to the second pusher arm 117, which is pivotally connected to the pusher arm 116 at pivot 119. Extending between the pusher arm 116 and the pusher arm 117 is the supplemental pusher arm cylinder 132. The extension of the supplemental pusher arm cylinder 132 increases the angle between the pusher arm 116 and the second pusher arm 117.

The distal end 156 of the plate pusher 108 is preferably offset in the vertical direction from a proximal end 154. The contact body 109 includes and is located between the distal end 154 and the proximal end 156 and is sized and shaped to offset the distal end 156 from the proximal end 154 to permit the engaging formation 114 to extend near the tie 20, while the remainder of the pusher assembly 52 is located a distance above the tie.

The distal end 156 is configured to engage the plate and includes the engaging formation 114, which is preferably an indentation 158 and two protrusions 160. As seen in FIG. 4B, the lower protrusion 160 can engage the field side shoulder 120 and push the plate along the tie 20, and as seen in FIG. 4D, the indentation 158 can catch and grip the plate 14 between the protrusions 160. Further, the shape of the distal end 156 permits the plate 14 to freely pivot while being grasped by the plate pusher 108. The pivoting motion of the plate 14 about the leading edge 110 results in some motion of the trailing edge 126 within the indentation 158.

The plate pusher assembly 52 is attached to the locating mechanism 48 at an upper cylinder attachment 162 and the pivot point 122. The plate pusher assembly 52 moves relative to the locating mechanism 48, the movement being dictated by the number, size, shape, attachment and linkages on the assembly.

While the preferred embodiment of plate pusher assembly 52 includes a two-bar, two-cylinder linkage with a single pivot point on the locating mechanism 48, other configurations are contemplated. Further, there can be one or more plate pushers 108 associated with the plate pusher assembly 52, or one or more plate pusher assemblies associated with the locating mechanism. Further still, the plate pusher assembly can operate independently of any other workhead.

In the preferred embodiment, the centering fingers 82 are located on the plate-centering mechanism 74 of the locating mechanism 48 in a spaced arrangement. Preferably, there are a plurality of centering fingers 82 and a plurality of tie grippers 58 on the workhead centering mechanism 142 of the locating mechanism 48. In this preferred embodiment, the spacing along the locating mechanism 48 is such that the centering fingers 82 are disposed alternately between the tie grippers 58.

While the centering fingers 82 do not center the plate 14 on the tie 20 in the first instance, the centering fingers 82 retain the plate 14 centered on the tie 20 while the plate pusher 108 slides the plate along the tie. The centering fingers 82 extend generally downward and outward from a bottom surface 164 of the plate-centering mechanism 74. The fingers 82 have a generally flat bottom surface 166 to engage the tie 20.

It will be appreciated that the present rail plate inserter workhead 10 features the ability to accurately place plates 14 on the tie 20. The rate of plate insertion accomplished by the present plate inserter workhead 10 is in the range of about 5-12 plates per minute, and overall, is as efficient or slightly more efficient than using manual labor for plate insertion, when issues of worker fatigue and manpower costs are eliminated. Also, the above-described drawbacks of conventional automatic plate insertion devices have been overcome.

While specific embodiments of the present railway vehicle having a plate inserter workhead have been shown and described, and specific embodiments of various workheads, mechanisms, and assemblies have been shown and described, it will be appreciated by those skilled in the art that changes and modifications may be made thereto without departing from the invention in its broader aspects and as set forth in the following claims.

What is claimed is:

1. A railway vehicle for inserting a tie plate on a rail tie that engages with a rail, said vehicle comprising:

a frame movable relative to the track;

a plate stopping mechanism mounted to said frame, said plate stopping mechanism having at least one stop that contacts a top surface of the rail tie on a first side of the rail;

a plate inserter workhead mounted to said frame and located on an opposite side of the rail from said at least one stop, said plate inserter workhead having at least one arm, at least one cylinder for moving said at least one arm, and a plate pusher attached to said at least one arm, upon actuation of said at least one cylinder, said plate pusher pushes the tie plate against said at least one stop and pivots a trailing edge of the tie plate about a leading edge of the tie plate while the leading edge contacts the tie so that a trailing edge of the tie plate is lifted off the tie.

2. The vehicle of claim 1 wherein said plate stopping mechanism includes at least one cylinder that applies pressure on said at least one stop.

3. The vehicle of claim 2 wherein said at least one cylinder applies pressure to said at least one stop of said plate stopping mechanism to oppose the motion of the plate pusher and to pivot the plate about its leading edge.

4. The vehicle of claim 1 wherein said plate inserter workhead is provided with a measuring device to calculate the gap distance between the top of the tie and the bottom of the rail.

5. A railway vehicle for inserting tie plates located on rail ties that engage with rails, each tie plate having a field side shoulder, said vehicle comprising:

a frame movable relative to the track;

a plate inserter workhead mounted to said frame, said plate inserter workhead having at least one arm, at least one cylinder for moving said at least one arm, and a plate pusher attached to said at least one arm that engages and pushes the tie plate at the field side shoulder to push the tie plate along the rail tie, wherein at all times during operation of the railway vehicle, said at least one arm and said at least one cylinder do not extend said plate pusher between the rail and the rail tie.

6. The railway vehicle of claim 5 wherein said plate inserter workhead further comprises a plate centering mechanism having at least one tie gripper arm that engages and lifts the tie.

7. A railway vehicle for inserting tie plates located on rail ties that engage with rails, said machine comprising:

a frame moveable relative to the track;

a late stopping mechanism mounted to said frame, said late stopping mechanism having at least one stop that contacts a top surface of the rail tie on a first side of the rail;

a plate inserter workhead mounted to said frames and located on an opposite side of the rail from said at least one stop, said plate inserter workhead having a first arm attached to said frame and moveable with a first cylinder, a second arm attached to said first arm and moveable with respect to the first arm with a second cylinder, and a plate pusher attached to said second arm, upon actuation of said first and second cylinders, said plate pusher pushes the tie plate against said at least one stop and pivots a trailing edge of the tie plate about a leading edge of the tie plate while the leading edge contacts the tie so that a trailing edge of the tie plate is lifted off the tie.

8. The railway vehicle of claim 7 further comprising at least one actuator on said plate stopping mechanism to oppose the movement of said at least one stop along the top surface of the rail tie transversely away from the rail.

* * * * *